US005868875A

United States Patent [19]

Yoshitake et al.

[11] Patent Number: 5,868,875

[45] Date of Patent: Feb. 9, 1999

[54] NON-RIDGING FERRITIC CHROMIUM ALLOYED STEEL AND METHOD OF MAKING

[76] Inventors: Eizo Yoshitake, 5001 Kilkerry Drive Ave., Middletown, Ohio 45044; Alan R. McKague, 322 Wexford Way, Monroe, Ohio 45050

[21] Appl. No.: 994,382

[22] Filed: Dec. 19, 1997

[51] Int. Cl.[6] ..... C21D 8/02; C22C 38/28

[52] U.S. Cl. ..... 148/325; 148/542; 148/547; 148/609; 148/608

[58] Field of Search ..... 148/542, 547, 148/608, 609, 325

[56] References Cited

U.S. PATENT DOCUMENTS

| | | | |
|---|---|---|---|
| 4,465,525 | 8/1984 | Yoshimura et al. | 148/37 |
| 4,515,644 | 5/1985 | Sawatani et al. | 148/12 |
| 4,964,926 | 10/1990 | Hill | 148/325 |
| 5,462,611 | 10/1995 | Uematsu et al. | 148/325 |
| 5,489,345 | 2/1996 | Koike et al. | 148/325 |
| 5,492,575 | 2/1996 | Teraoka et al. | 148/542 |
| 5,505,797 | 4/1996 | Yokota et al. | 148/610 |
| 5,662,864 | 9/1997 | Kato et al. | 420/70 |

FOREIGN PATENT DOCUMENTS

| | | | |
|---|---|---|---|
| 785283 | 7/1997 | European Pat. Off. | C21C 7/06 |

*Primary Examiner*—Deborah Yee
*Attorney, Agent, or Firm*—R. J. Bunyard; L. A. Fillnow

[57] ABSTRACT

A ferritic non-ridging stainless steel and process therefor. A chromium alloyed steel melt is deoxidized with a sub-equilibrium amount of titanium and nitrogen and continuously cast into a strip or a slab or cast into an ingot having an as-cast fine equiaxed microstructure substantially free of columnar grains. The as-cast steel contains ≦0.010% Al, up to 0.08% C, 0.10–1.50% Mn, ≦0.05% N, ≦1.5% Si, 8–25% Cr, <2.0% Ni and is deoxidized with titanium, all percentages by weight, the balance Fe and residual elements. Preferably, the titanium is controlled so that (Ti/48)/[(C/12)+(N/14)]>1.5. A hot processed continuous sheet may be formed from a continuously cast slab without surface grinding, may be descaled, cold reduced to a final thickness and recrystallization annealed. An anneal prior to cold reduction is not required to obtain an annealed sheet essentially free of ridging.

25 Claims, 5 Drawing Sheets

LESS-UNIFORM AREA

UNIFORM AREA

NON-RIDGING FERRITIC CHROMIUM ALLOYED STEEL AND METHOD OF MAKING

BACKGROUND OF THE INVENTION

This invention relates to a ferritic chromium alloyed steel formed from a melt deoxidized with titanium and having an as-cast fine equiaxed grain structure. More particularly, this invention relates to a ferritic chromium alloyed steel formed from a melt deoxidized with titanium and containing low aluminum. A hot processed sheet produced from the steel having this equiaxed grain microstructure is especially suitable for a cold reduced, recrystallization annealed sheet having excellent formability, stretching and non-ridging characteristics.

A requirement of a highly formable ferritic stainless steel, in addition to having a high $r_m$, is that it be free of a phenomenon known as "ridging", "roping" or "ribbing". Unsightly ridging may appear on the surfaces of a cold reduced, recrystallization annealed ferritic stainless steel sheet that is to be subjected to cold forming. "Ridging" is characterized by the formation of ridges, grooves or corrugations which extend in a parallel direction to the rolling direction of the sheet. This defect not only is detrimental to the surface appearance of the sheet but also results in poor formability.

Ferritic chromium alloyed steels, especially sub-equilibrium chromium alloyed steels such as stainless Type 409, 430 and 439, typically have an as-cast columnar large grain structure, whether continuously cast into slab thicknesses of 50–200 mm, or strip cast into thicknesses of 2–10 mm. These columnar grains have a near cube-on-face crystallographic texture which leads to a very undesirable ridging characteristic in a final cold rolled, annealed sheet used in various fabricating applications. The surface appearance resulting from ridging is highly objectionable in exposed formed parts such as caskets, automotive trim, exhaust tubes and end cones, stamped mufflers, oil filters, and the like. Ridging causes the sheet to have a rough, uneven surface appearance after forming attributed to a cold rolled, annealed, large non-uniform grain size resulting from the initial occurrence of a columnar grain structure in the as-cast steel. This uneven surface appearance is aesthetically objectionable. To minimize ridging, an extra costly production step of annealing a hot rolled sheet prior to cold reduction is required. This extra annealing of the ferritic stainless steel also results in reduced formability caused by lower average strain ratios required for deep drawability. Additionally, a hot processed sheet that is annealed before cold reduction must be cold reduced at least 70% to obtain an $r_m$ value after final annealing similar to the $r_m$ value for a hot processed sheet that otherwise is not annealed before cold reduction.

Over the years, there also have been numerous attempts to eliminate ridging by modifying the alloy composition of ferritic stainless steel. It is known ridging in a ferritic stainless steel originates primarily during hot rolling. For example, there have been attempts to minimize ridging by casting a steel ingot by forming a fine equiaxed grain microstructure by controlling chemistry of the melt, e.g., one or more of the impurities of C, N, O, S, P, and by refining grain microstructure by using low hot rolling temperatures, e.g., 950°–1100° C. Chemistry control during refining generally has produced improved ridging characteristics for ferritic stainless steels because of the formation of a second phase, i.e., austenite and martensite. However, formation of this second phase generally reduces the elongation and welding performance of the final products. Temperature control during hot rolling has resulted in operational difficulties as well because of low productivity since this requires a high power hot rolling mill and the hot rolling must be followed by cold rolling in at least two stages with an intermediate anneal between the two cold rollings.

Others have attempted to eliminate ridging by modifying an alloy composition of ferritic stainless steel by the addition of one or more stabilizing elements. For example, U.S. Pat. No. 4,465,525 relates to a ferritic stainless steel having excellent formability and improved surface quality. This patent discloses that boron in amounts of 2–30 ppm and at least 0.005% aluminum can increase the elongation and the $r_m$ value as well as decrease the ridging characteristic. U.S. Pat. No. 4,515,644 relates to a deep drawing ferritic stainless steel having improved ridging quality. This patent discloses that an addition of aluminum, boron, titanium, niobium, zirconium and vanadium all can increase the ferritic stainless steel's elongation, increase the $r_m$ value and enhance the anti-ridging property. More specifically, this patent discloses a ferritic stainless steel having at least 0.01% Al has improved anti-ridging characteristics. U.S. Pat. No. 4,964,926 relates to weldable dual stabilized ferritic stainless steel having improved surface quality. This patent discloses it was known that roping characteristics could be improved by adding niobium alone or niobium and copper to a ferritic stainless steel. However, the addition of niobium alone caused weld cracking. U.S. Pat. No. 4,964,926 discloses that an addition of at least 0.05% titanium to a niobium stabilized steel, i.e., dual stabilized, eliminates weld cracking. U.S. Pat. No. 5,662,864 relates to producing a ferritic stainless steel having good ridging characteristics when Ti, C+N and N/C are carefully controlled. This patent teaches ridging can be improved due to formation of carbonitrides by adding Ti in response to the C+N content in a melt. The steel melt contains $\leqq$0.01% C, $\leqq$1.0% Mn, $\leqq$1.0% Si, 9–50% Cr, $\leqq$0.07% Al, $0.006 \leqq C+N \leqq 0.025\%$, N/C $\leqq$2.07, $(Ti-2S-3O)/(C+N) \geqq 4$ and $TixN \leqq 30\times10^{-4}$. U.S. Pat. No. 5,505,797 relates to producing a ferritic stainless steel having reduced intra-face anisotropy and an excellent $r_m$. This patent teaches good ridging characteristics are obtained when the steel melt contains 0.0010–0.080% C, 0.10–1.50% Mn, 0.10–0.80% Si, 14–19% Cr and two or more of 0.010–0.20% Al, 0.050–0.30% Nb, 0.050–0.30% Ti and 0.050–0.30% Zr. The steel is cast into a slab and hot rolled to a sheet having thickness of 4 mm, annealed, pickled, cold rolled and finish annealed. The slab was heated to 1200° C. and subjected to at least one rough hot rolling pass at a temperature between 970°–1150° C. The friction between the hot mill rolls and the hot rolled steel was 0.3 or less, the rolling reduction ratio was between 40–75% and the hot rolling finishing temperature was 600°–950° C. The hot rolled steel was annealed at a temperature of 850° C. for 4 hours, was cold reduced 82.5% and finish annealed at a temperature of 860° C. for 60 seconds.

As evidenced by the seemingly endless struggle of others, there remains a long felt need for an annealed ferritic chromium alloyed steel that is essentially free of ridging and having excellent deep formability characteristics such has a good $r_m$ value, a high tensile elongation and an annealed uniform grain structure. There remains a further need for an excellent deep formability ferritic stainless steel having good ridging characteristics that does not require a hot processed sheet to be annealed prior to cold reduction. There remains a further need for an excellent deep formability ferritic stainless steel having good ridging characteristics formed from a hot processed sheet that does not have surface defects, i.e., titanium nitride scale and titanium oxide streaks, without requiring surface conditioning of the surfaces of a continuously cast slab prior to hot processing of the slab.

BRIEF SUMMARY OF THE INVENTION

A principal object of this invention is to provide an excellent deep formability and stretching ferritic chromium alloyed steel with good ridging characteristics without requiring a hot processed sheet to be annealed prior to cold reduction.

Another object of this invention is to provide an excellent deep formability ferritic chromium alloyed steel with good ridging characteristics and improved formability, i.e., high $r_m$ and high tensile elongation.

Another object of this invention is to form a ferritic chromium alloyed steel sheet from a continuously cast slab that does not require surface conditioning prior to hot processing the steel slab.

Another object of this invention is to provide an excellent deep formability ferritic chromium alloyed steel sheet with good ridging characteristics formed from a continuously cast slab that does not require surface conditioning prior to hot processing the steel slab.

Additional objects include providing an excellent deep formability ferritic chromium alloyed steel with good ridging characteristics having improved weldability, corrosion resistance and high temperature cyclical oxidation resistance.

The invention relates to a ferritic chromium alloyed steel and a process for producing the steel having an as-cast microstructure greater than 50% equiaxed grains. The as-cast steel contains ≦0.010% Al, up to 0.08% C, up to 1.50% Mn, ≦0.05% N, ≦1.5% Si, 8–25% Cr, <2.0% Ni and means for deoxidizing the steel, all percentages by weight, the balance Fe and residual elements. The deoxidizing means consists of titanium. The as-cast steel is hot processed into a continuous sheet. The sheet may be descaled, cold reduced to a final thickness and then recrystallization annealed. Annealing the hot processed sheet prior to cold reduction to eliminate ridging in the final annealed sheet is not necessary.

Another feature of this invention is for the aforesaid Ti being ≧0.01%.

Another feature of this invention is for the aforesaid Al being ≦0.007%.

Another feature of this invention is for the aforesaid Ti and N being present in sub-equilibrium amounts.

Another feature of this invention is for the aforesaid Ti satisfying the relationship $(Ti/48)/[(C/12)+(N/14)]>1.5$.

Another feature of this invention is for the aforesaid annealed sheet to have an $r_m$ value of ≧1.4.

Another feature of this invention is for the aforesaid as-cast equiaxed grains having a size less than 3 mm.

Another feature of this invention is for the aforesaid as-cast microstructure having a high fraction of fine equiaxed grains.

Advantages of this invention include a highly formable ferritic chromium alloyed steel with excellent ridging characteristics that is less costly to manufacture, does not require a hot processed sheet to be annealed prior to cold reduction, has improved surface quality, has improved weldability, good wet corrosion resistance and has good high temperature cyclical oxidation resistance. Another advantage is being able to cast a slab that does not require surface conditioning, e.g., grinding, prior to hot processing to prevent formation of open surface defects extending parallel to the rolling direction in a hot processed sheet such hot rolling scale and streaks rolled from non-metallic titanium oxide or titanium nitride cluster type precipitates formed near a slab surface during casting. Another advantage of this invention includes a highly formable ferritic chromium alloyed steel sheet with excellent ridging characteristics that has a very uniform grain structure in the sheet after annealing.

The above and other objects, features and advantages of this invention will become apparent upon consideration of the detailed description and appended drawings.

DETAILED DESCRIPTION OF THE PREFERRED EMBODIMENT

Figure 1:
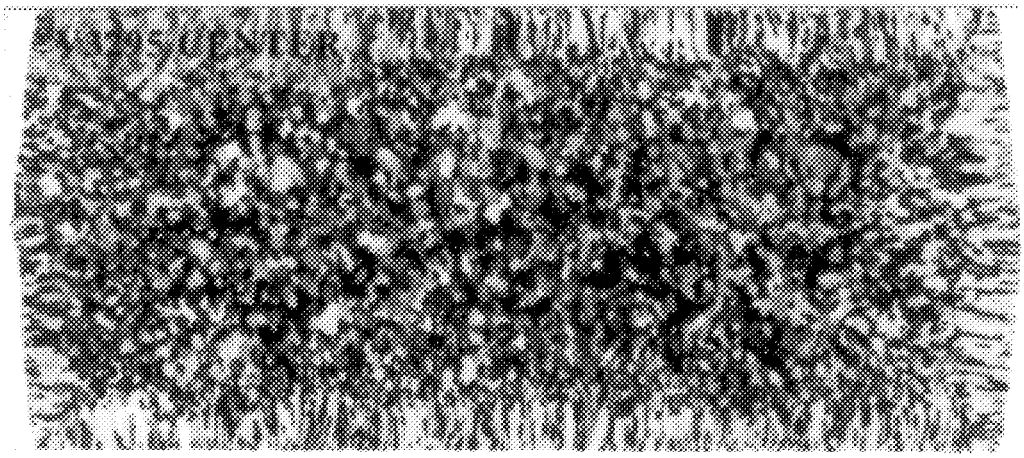
FIG. 1 is a photograph of the as-cast grain microstructure of a ferritic chromium alloyed steel of this invention containing low aluminum.

This invention relates to forming a highly formable ferritic alloyed steel sheet from a chromium alloyed ferrous steel having an as-cast microstructure of fine equiaxed grains. A chromium alloyed ferrous melt is deoxidized with means to provide the necessary nuclei for forming the as-cast equiaxed grain microstructure so that an annealed chromium alloyed steel produced from this melt has enhanced non-ridging characteristics. This deoxidizing means consists of titanium. By forming a chromium alloyed ferrous melt rich in titanium inclusions rather than aluminum inclusions, an as-cast microstructure having greater than 50% equiaxed grains can be formed.

By ferritic chromium alloyed steel is meant to include a steel alloyed with at least about 8% chromium. The ferritic chromium alloyed steels of this invention are especially suited for hot processed sheets, cold reduced sheets and metallic coated sheets. These ferritic chromium alloyed steels are well suited for any of the stainless steels of the AISI Type 400 series containing about 10–25% Cr, especially of the 409 Type stainless steel containing about 11–13% Cr. For this invention, it also will be understood that by "sheet" is meant to include continuous strip, continuous foil and cut lengths.

A ferrous melt is provided in a melting furnace such as an electric arc furnace (EAF). This ferrous melt may be formed in the melting furnace from solid iron bearing scrap, carbon steel scrap, stainless steel scrap, solid iron containing materials including iron oxides, iron carbide, direct reduced iron, hot briquetted iron, or the melt may be produced upstream of the melting furnace in a blast furnace or any other iron smelting unit capable of providing a ferrous melt. The ferrous melt then will be refined in the melting furnace or transferred to a refining vessel such an argon-oxygen-decarburization vessel (AOD) or a vacuum-oxygen-decarburization vessel (VOD), followed by a trim station such as a ladle metallurgy furnace (LMF) or a wire feed station. An important feature of this invention is after refining the melt to a final carbon analysis and during or after trim alloys to meet a final specification are added to the melt, means for deoxidation is added to the melt prior to casting. This deoxidation means consists of titanium. Another important feature of this invention is aluminum specifically is not to be added to this refined melt as a deoxidant. If the steel is to be stabilized, sufficient amount of the titanium beyond that required for deoxidation can be added for combining with carbon and nitrogen in the melt. Preferably, the amount of added Ti is less than that required for equilibrium with nitrogen thereby avoiding precipitation of titanium nitride before solidification of the melt. Alternatively, one or more stabilizing elements such as niobium, zirconium, tantalum and vanadium can be added to the melt as well. Accordingly, the low aluminum steel of this invention preferably has at least 0.01% titanium added to the melt so that the steel is essentially deoxidized by the titanium to insure formation of an as-cast microstructure formed of a fine equiaxed grain structure. By low aluminum is meant the steel contains up to 0.010% total Al. Steels containing more than 0.010% Al were observed to have banded structures indicating the as-cast slab microstructure was columnar.

After being refined and alloyed with chromium in a melting or refining vessel, the low aluminum, chromium alloyed, ferrous steel melt will be deoxidized with titanium and contain up to 0.08% C, ≦0.05% N, up to 1.50% Mn, ≦1.5% Si, 8–25% Cr, <2.0% Ni, all percentages by weight, the balance Fe and residual elements. The chromium alloyed steel melt may be continuously cast into a sheet, a thin slab ≦140 mm, a thick slab ≦200 mm or cast into an ingot having an as-cast microstructure formed of a fine equiaxed grain structure greater than 50%, preferably at least 60%, more preferably at least 80% and most preferably the microstructure having essentially all fine equiaxed grains and be substantially free of large columnar grains. The cast steel then is hot processed into a continuous length of sheet. By "hot processed" will be understood the as-cast steel will be reheated, if necessary, and then reduced to a predetermined thickness such as by hot rolling. If hot rolled, a steel slab is reheated to 1050°–1300° C., hot rolled using a finishing temperature of at least 800° C. and coiled at a temperature ≧580° C. Additionally, the hot rolled sheet then may be descaled and cold reduced at least 40%, preferably at least 50%, to the desired final sheet thickness. Thereafter, the cold reduced sheet will be recrystallization annealed for at least 1 second at a peak metal temperature of 800°–1000° C. A significant advantage of this invention is that the hot processed sheet is not required to be annealed prior to cold reduction, i.e., a hot band anneal, to suppress the formation of ridging. The recrystallization annealing following cold reduction may be a continuous anneal or a box anneal. Another advantage of this invention is that an alloyed annealed steel sheet with excellent ridging characteristics has a very uniform grain structure with as little as 40% cold reduction.

The ferritic chromium alloyed steel of the present invention can be produced from a hot processed sheet made by a number of methods. The sheet can be produced from slabs formed from ingots or continuous cast slabs which are reheated to 1050°–1300° C. followed by hot rolling to provide a starting hot processed sheet of 2–6 mm thickness or the sheet can be hot processed from strip continuously cast into thicknesses of 2–10 mm. The present invention also is applicable to sheet produced by methods wherein continuous cast slabs or slabs produced from ingots are fed directly to a hot mill with or without significant heating, or ingots hot reduced into slabs of sufficient temperature to hot roll to sheet with or without further heating, or the molten metal is cast directly into a sheet suitable for further processing.

An important feature of this invention is that the total aluminum is maintained to no more than 0.010%, preferably <0.010%, more preferably ≦0.007% and most preferably ≦0.005%. If aluminum is not purposefully alloyed with the melt during refining or casting such as for deoxidation immediately prior to casting, total aluminum can be controlled to less than 0.010%. Aluminum preferably is not to be inadvertently added to the melt as an impurity present in an alloy addition of another element, e.g., titanium. That is, the use of titanium alloy additions containing an impurity of aluminum should be avoided. Titanium alloys may contain as much as 20% Al which may contribute as much as 0.07% total Al to the melt. By carefully controlling the refining and casting practices, a melt containing no more than 0.010% aluminum can be obtained.

Not being bound by theory, it is believed total Al should not exceed 0.010% to suppress the formation of $Al_2O_3$ particles in the melt. Steel continuously cast into a thin slab or a continuous sheet does not inherently have an as-cast fine equiaxed grain microstructure. It is believed by carefully controlling the aluminum to no more than 0.010 wt. % in this invention, the formation of $Al_2O_3$ particles can be minimized. By suppressing the formation of $Al_2O_3$, it is further believed that small particles having a size less than 10 $\mu$m, preferably less than 5 $\mu$m and more preferably less than 1 $\mu$m of the complex oxides of titanium become the dominant non-metallic particles in the melt. These small complex titanium oxide particles are believed to provide nucleation sites permitting the formation of an as-cast fine equiaxed grain structure during solidification.

Aluminum deoxidized steels of the prior art tended to clog nozzles during continuous casting. Calcium generally was required to be added to the high aluminum steel to increase the fluidity of $Al_2O_3$ particles in the cast melt to minimize this tendency to plug the casting nozzle. However, calcium generally adversely affects the formation of an as-cast fine equiaxed grain. Accordingly, calcium should be limited to ≦0.0020%. An important advantage of this invention is to obviate the need for the addition of calcium to the low aluminum melt since very few $Al_2O_3$ particles are present in the melt when aluminum is maintained less than 0.010%. Large numbers of $Al_2O_3$ particles contained in a melt can quickly coalesce into large clusters of $Al_2O_3$ which can cause nozzle clogging during continuous casting.

Figure 4:
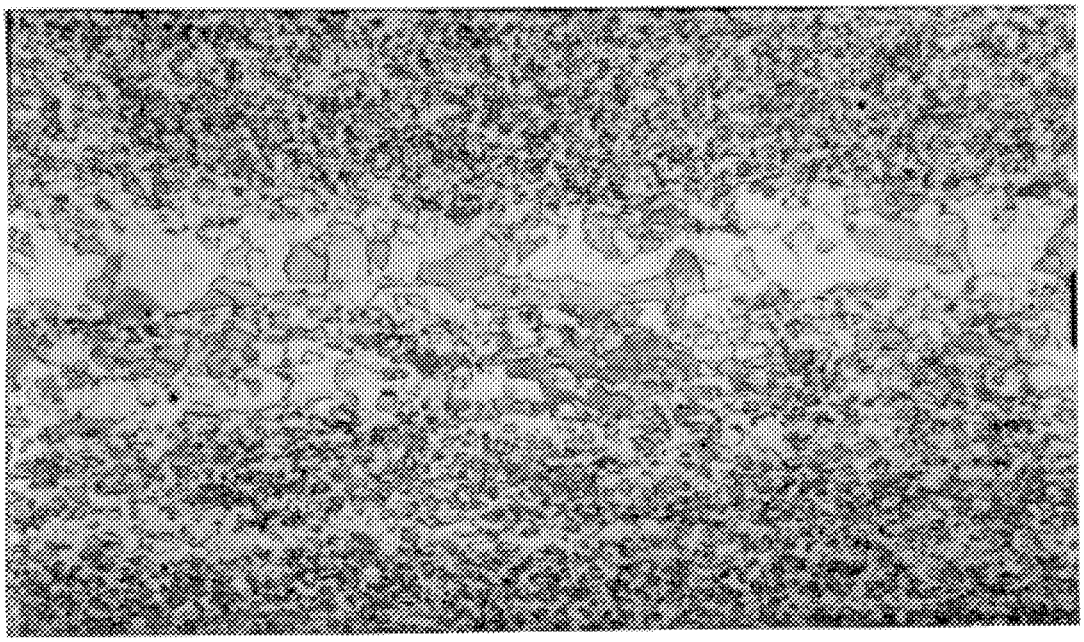

Another feature of this invention is that only titanium is used for deoxidation of the melt prior to casting with this melt preferably containing a "sub-equilibrium" amount of titanium of at least 0.01%. More preferably, the amount of Ti in this steel melt satisfies the relationship $(Ti/48)/[(C/12)+(N/14)]>1.5$. By "sub-equilibrium" is meant the amount of titanium is controlled so that the solubility products of titanium compounds are below the saturation level at the liquidus temperature thereby avoiding TiN precipitation in the melt. If TiN particles are allowed to form, the TiN precipitates coalesce into low density large clusters which will float to solidifying slab surfaces during continuous casting. The amount of titanium permitted in the melt to avoid TiN precipitation is inversely related to the amount of nitrogen. The maximum amount of titanium for "sub-equilibrium" is illustrated in FIG. 4 in U.S. Pat. No. 4,964,926, incorporated herein by reference. That is, depending upon the chromium and nitrogen content of a molten steel alloy, the amount of titanium must be controlled to less than that indicated by the curves in FIG. 4. Having a sub-equilibrium amount of titanium to prevent TiN precipitation inclusions in the melt is important to prevent the formation of a surface defect known as a Ti-streak. If these non-metallic TiN inclusions are allowed to precipitate in the melt, i.e., hyper-equilibrium, open surface defects form during hot rolling if these TiN inclusions precipitate near slab surfaces during solidification of the slab. These non-metallic TiN inclusions must be removed from the slab by surface conditioning such as grinding prior to hot processing of the slab.

Nitrogen is present in the steels of the present invention in an amount of ≦0.05%, preferably ≦0.03% and more preferably ≦0.012%. In this invention, it is desirable to control the amount of nitrogen to avoid TiN precipitation in the melt, i.e., sub-equilibrium, thereby encouraging formation of titanium oxides instead. It is believed that small particles of the complex oxides of titanium are responsible for providing the nucleation sites necessary for the formation of an as-cast fine equiaxed grain structure. By carefully controlling the amounts of titanium and nitrogen in the melt below the solubility limit of TiN, small $TiO_2$ particles having a size less than 1 $\mu$m will form instead providing the necessary nucleation sites responsible for the fine as-cast equiaxed grain microstructure.

For any casting temperature, a steel alloy composition can be controlled with respect to N and the sub-equilibrium amount of Ti to obviate TiN precipitation. Although N concentrations after melting in an EAF may be as high as 0.05%, the amount of dissolved N can be reduced during inert gas refining in an AOD to less than 0.02% and, if necessary, to less than 0.01%. Precipitation of TiN can be avoided by reducing the sub-equilibrium amount of Ti to be added to the melt for any given nitrogen content. Alternatively, the sub-equilibrium amount of nitrogen in the melt can be reduced in an AOD for an anticipated amount of Ti contained in the melt. For a sub-equilibrium T409 stainless steel containing about 11–13% Cr and no more than about 0.012% N, the steel melt would contain less than about 0.25% Ti to avoid TiN precipitation before solidification of the melt. For a sub-equilibrium T439 stainless steel containing about 16–18% Cr and no more than about 0.014% N, the steel melt would contain less than about 0.35% Ti to avoid TiN precipatation before solidification of the melt.

Carbon is present in the steels of the present invention in an amount of up to 0.08%, preferably ≦0.02% and more preferably 0.0010–0.01%. If carbon exceeds about 0.08%, the formability, corrosion and weldability are deteriorated. Accordingly, carbon should be reduced to an amount as low as possible.

An element for stabilizing carbon and nitrogen may be present in the steels of the present invention in an amount of 0.05–1.0%, preferably 0.10–0.45%, more preferably 0.15–0.25% and most preferably 0.18–0.25%. If a stabilized steel is desired, the stabilizing element should be at least 0.05% to form a stable carbo-nitride compound effective for making a crystalline grain size for increasing the elongation and toughness of the stainless steel thereby enhancing formability such as deep drawability after annealing. If the stabilizing element is greater than about 1.0%, formability of the steel is no longer enhanced and the cost of producing the steel increased. In addition to titanium, a suitable stabilizing element may also include niobium, zirconium, tantalum, vanadium or mixtures thereof with titanium alone being preferred. If a second stabilizing element other than titanium is used, e.g., niobium, the second stabilizing element should be limited to no more than about 0.25%. Nb above 0.25% adversely affects formability.

Chromium is present in the steels of the present invention in an amount of ≧8%, preferably ≧10%. If chromium is less than about 8%, the wet corrosion resistance of the steel is adversely affected. If chromium is greater than about 25%, the formability of the steel is deteriorated.

Silicon is generally present in the chromium alloyed steels of the present invention in an amount of ≦1.5%, preferably of ≦0.5%. A small amount of silicon generally is present in a ferritic stainless steel to promote formation of the ferrite phase. Silicon also enhances high temperature corrosion resistance and provides high temperature strength. Accordingly, silicon should be present in the melt in an amount of at least 0.10%. Silicon should not exceed about 1.5% because the steel is too hard and the elongation is adversely affected.

Manganese is present in the steels of the present invention in an amount up to 1.5%, preferably less than 0.5%. Manganese improves hot workability by combining with sulfur as manganese sulfide to prevent tearing of the sheet during hot processing. Accordingly, manganese in amounts of at least 0.1% is desirable. However, manganese is an austenite former and affects the stabilization of the ferrite phase. If the amount of manganese exceeds about 1.5%, the stabilization and formability of the steel is adversely affected.

Sulfur is present in the steels of the present invention preferably in an amount of ≦0.015%, more preferably <0.010% and most preferably <0.005%. In addition to causing a problem during hot rolling, sulfur adversely affects wet corrosion resistance, especially those steels containing a lower amount of chromium. Accordingly, the sulfur preferably should not exceed about 0.015%.

Like manganese, nickel is an austenite former and affects the stabilization of the ferrite phase. Accordingly, nickel is limited to ≦2.0%, preferably <1.0%.

The ferritic chromium alloyed steel of this invention may also include other elements such as copper, molybdenum, phosphorus and the like made either as deliberate additions or present as residual elements, i.e., impurities from steel-making process.

EXAMPLE 1

Figure 2:
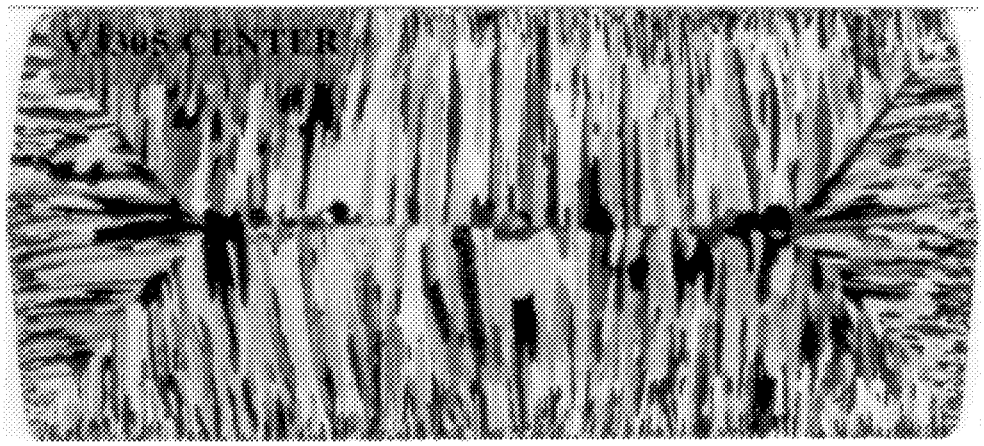
FIG. 2 is a photograph of the as-cast grain microstructure of a ferritic chromium alloyed steel of the prior art containing high aluminum.

A chromium alloyed ferrous melt for this invention of about 25 kg was provided in a laboratory vacuum vessel. After final trim alloying elements were added to the vessel, the melt was deoxidized with titanium. The composition of the chromium alloyed steel melt was 0.009% Al, 0.18% Ti, 0.0068% C, 0.26% Mn, 0.51% Si, 11.1% Cr, 0.20% Ni and 0.0081% N. The steel melt was cast into ingots having a thickness and width of about 75 mm and about 150 mm respectively. The as-cast microstructure of cross-section pieces cut from the stainless steel ingots had a fine grain structure of about 80% equiaxed grains and an average size of about 1 mm as shown in FIG. 1. These slab pieces contained inclusions primarily of $TiO_2$. A comparative steel of the prior art containing >0.010% Al is illustrated in FIG. 2. These high aluminum prior art as-cast steel microstructures generally contain ≦10% equiaxed grains.

EXAMPLE 2

Figure 3:
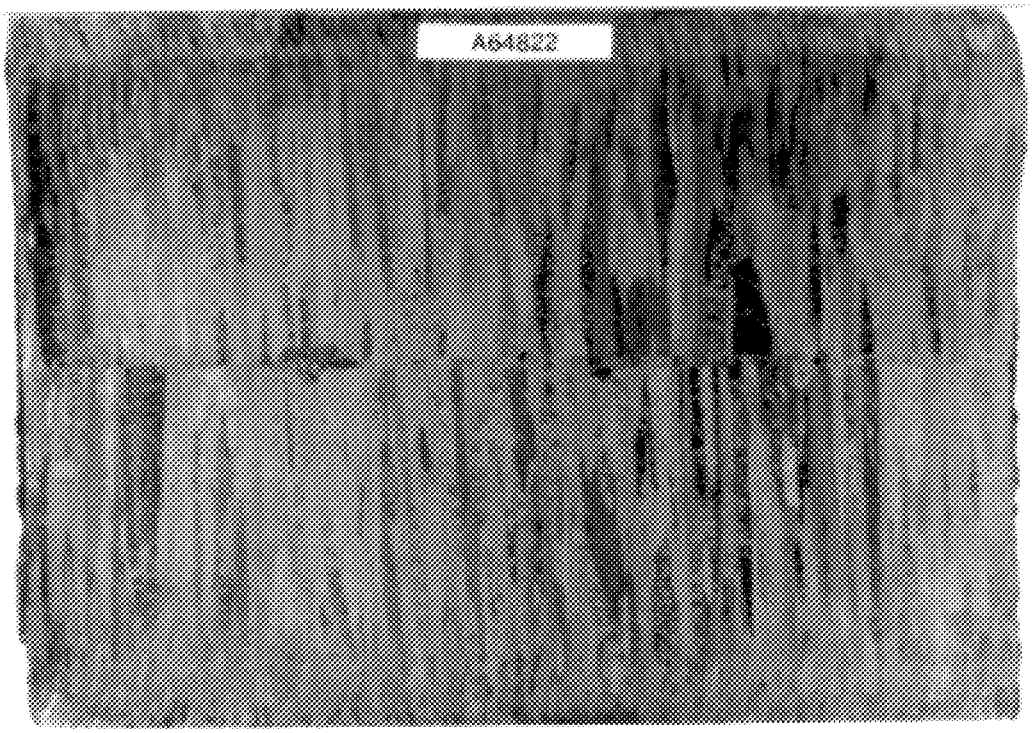
FIG. 3 is a photograph of the as-cast grain microstructure of another ferritic chromium alloyed steel of the prior art containing high aluminum, FIG. 4 demonstrates a non-uniform large grain structure typical of the high aluminum ferritic stainless steel of FIG. 3 after annealing.

A chromium alloyed ferrous melt of about 125 metric tons was provided in an AOD refining vessel. After carbon was reduced to the final specification, the melt was transferred to a LMF wherein final trim alloying elements were added. After it was determined that the melt was within the final chemical specification, the melt was deoxidized with titanium. The composition of the melt was 0.18% Ti, 0.022% Al, 0.007% C, 0.22% Mn, 0.17% Si, 10.6% Cr, 0.14% Ni, 0.01% N, 0.0010% Ca, 0.10% Cu, 0.03% Mo and 0.029% V. The steel melt then was transferred to a caster within about 40 minutes and then continuously cast into thin slabs having a thickness of 130 mm and a width of 1200 mm. Cross-section pieces were cut from a mid-width position at several locations along the length of the thin slab. As-cast microstructure of these pieces cut from a slab of this high aluminum stainless steel had a large columnar grain microstructure as illustrated in FIG. 3. FIG. 3 illustrates a ferritic stainless steel outside the invention having 0.022% Al had a microstructure of nearly 100% large columnar grains. The large columnar grains of FIG. 3 have an average diameter of about 3 mm.

Slabs cast from this melt were reheated to 1250° C., hot processed to a thickness of 3.3 mm with a finishing temperature of about 800° C. and coiled at a temperature of about 700° C. The hot processed sheet was descaled, pickled in nitric and hydrofluoric acid and cold reduced 58% to a thickness of 1.4 mm. This hot processed sheet was not annealed prior to cold reduction. The cold reduced sheet was annealed at peak metal temperature of 870° C. for about 60 seconds. After stretching, the ridging characteristic on the sheet was 3–4 and had an $r_m$ of 1.22–1.27. A ridging characteristic of 3 or more means moderate to severe ridging on a scale of 0–6. A high ridging characteristic of 3 or more and a low $r_m$ of less than 1.3 are unacceptable for many deep formability, exposed, ferritic stainless steel applications. The mechanical properties for this steel are summarized in Table 1. The cold rolled and annealed grain structure is shown in FIG. 4 exhibiting a non-uniform grain structure.

EXAMPLE 3

Figure 5:
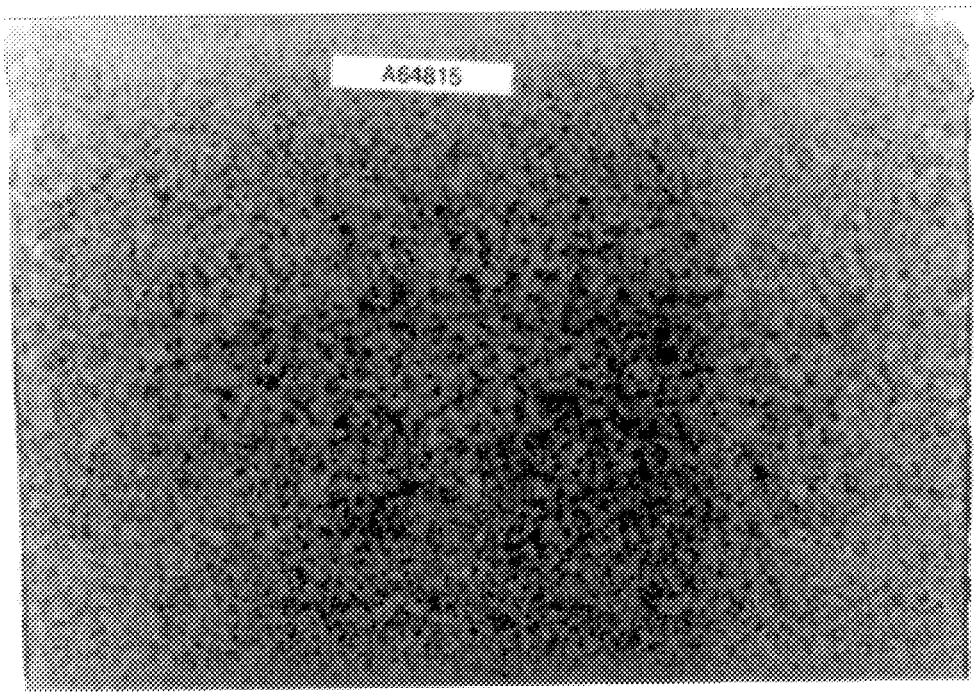
FIG. 5 is a photograph of the as-cast grain microstructure of another ferritic chromium alloyed steel of this invention containing low aluminum.

Another chromium alloyed ferrous melt of this invention was produced similar to that of Example 2 except the melt was low aluminum and the final trim alloys were added at the LMF after the melt was deoxidized with titanium. The composition of the melt was 0.19% Ti, 0.005% Al, 0.008% C, 0.12% Mn, 0.16% Si, 10.7% Cr, 0.13% Ni, 0.009% N, 0.001% S, 0.09% Cu, 0.03% Mo, 0.025% V and 0.0009% Ca. The steel melt was continuously cast into slabs having a thickness of 130 mm as described for Example 2. The as-cast microstructures of cross-section pieces cut from these thin slabs are shown in FIG. 5. FIG. 5 demonstrates that a ferritic stainless steel of this invention having 0.005% Al had a microstructure of nearly 100% fine equiaxed grains having a size of about 1 mm.

Figure 6:
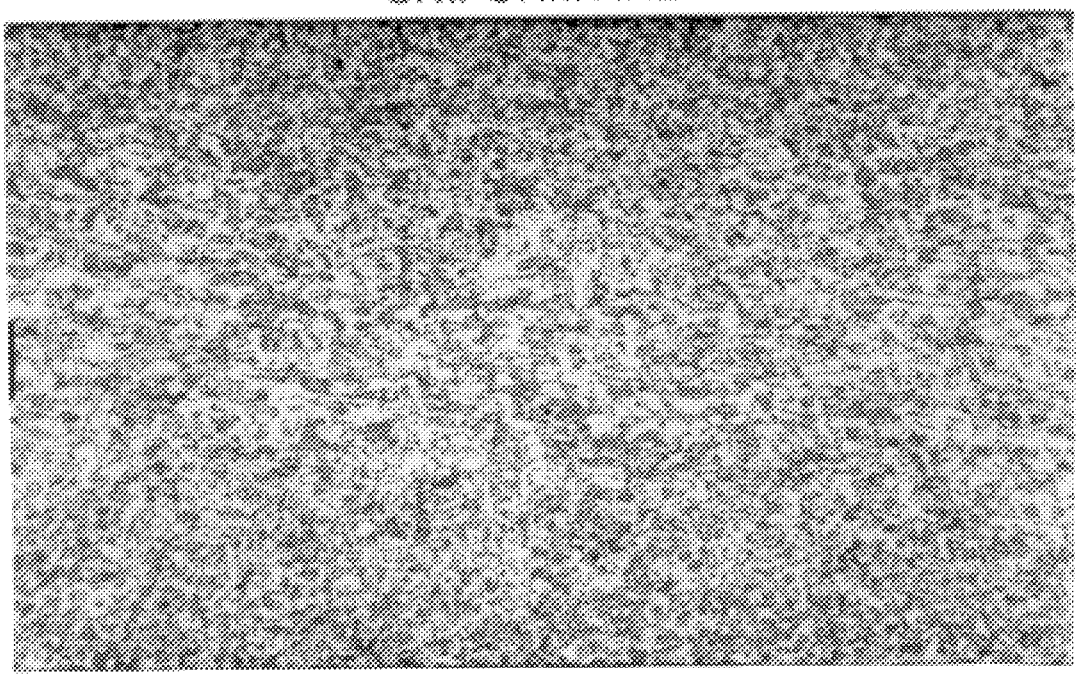
FIG. 6 illustrates a uniform grain structure of the ferritic stainless steel containing low aluminum of FIG. 5 after annealing.

These thin slabs were reheated to 1250° C., hot processed to a thickness of 3.3 mm with a finishing temperature of 800° C. and coiled at a temperature of 700° C. The hot processed sheet was descaled, pickled in nitric and hydrofluoric acid and cold reduced 58% to a thickness of 1.4 mm. This hot processed sheet was not annealed prior to cold reduction. The cold reduced sheet was annealed at a peak metal temperature of 870° C. for 60 seconds. After stretching, the ridging characteristic on the annealed sheet was 1 and had an $r_m$ value of 1.44–1.45. A ridging characteristic of 1 means excellent ridging and the steel is essentially free of ridging. A ridging characteristic of 2 or less and an $r_m$ value of at least 1.4 are acceptable for most deep forming, exposed ferritic stainless steel applications. Mechanical properties of the sheets of the invention are summarized in Table 2. The cold rolled and annealed grain structure is shown in FIG. 6 exhibiting a very uniform grain structure.

One very important advantage of the present invention relates to a recrystallized annealed final product. Prior art ferritic stainless steels not only were adversely affected by ridging but also had poor formability, i.e., low $r_m$ values. One reason that ferritic stainless steels have limited formability is because the grain structure after annealing is non-uniform. FIG. 4 illustrates a typical non-uniform grain structure of a comparative prior art ferritic stainless steel after annealing containing 0.022% aluminum. FIG. 6 illustrates a uniform grain structure of a ferritic stainless steel after annealing of this invention. As demonstrated in FIG. 6, the grain structure of a ferritic stainless steel after annealing of this invention

TABLE 1

| Longitudinal Tensile | | | | | Transverse Tensile | | | | | | |
|---|---|---|---|---|---|---|---|---|---|---|---|
| YPE % | 0.2% YS ($kg/mm_2$) | UTS ($kg/mm_2$) | Elong. % | $R_B$ | YPE % | 0.2% YS ($kg/mm_2$) | UTS ($kg/mm_2$) | Elong. % | $R_B$ | $r_m$ | Ridging |
| 0.3 | 21 | 41 | 34 | 63 | 0.3 | 22 | 43 | 32 | 63 | 1.24 | 3–4 |

TABLE 2

| Longitudinal Tensile | | | | | Transverse Tensile | | | | | | |
|---|---|---|---|---|---|---|---|---|---|---|---|
| YPE % | 0.2% YS ($kg/mm_2$) | UTS ($kg/mm_2$) | Elong. % | $R_B$ | YPE % | 0.2% YS ($kg/mm_2$) | UTS ($kg/mm_2$) | Elong. % | $R_B$ | $r_m$ | Ridging |
| 0.0 | 21 | 42 | 34 | 64 | 0.6 | 22 | 43 | 34 | 63 | 1.45 | 1 |

TABLE 3

| Longitudinal Tensile | | | | | Transverse Tensile | | | | | | |
|---|---|---|---|---|---|---|---|---|---|---|---|
| YPE % | 0.2% YS ($kg/mm_2$) | UTS ($kg/mm_2$) | Elong. % | $R_B$ | YPE % | 0.2% YS ($kg/mm_2$) | UTS ($kg/mm_2$) | Elong. % | $R_B$ | $r_m$ | Ridging |
| 0.6 | 21 | 41 | 37 | 64 | 0.6 | 22 | 42 | 36 | 63 | 1.43 | 1–2 |

TABLE 4

| Longitudinal Tensile | | | | | Transverse Tensile | | | | | | |
|---|---|---|---|---|---|---|---|---|---|---|---|
| YPE % | 0.2% YS ($kg/mm_2$) | UTS ($kg/mm_2$) | Elong. % | $R_B$ | YPE % | 0.2% YS ($kg/mm_2$) | UTS ($kg/mm_2$) | Elong. % | $R_B$ | $r_m$ | Ridging |
| | | | | | 66% Cold Reduction | | | | | | |
| 0.4 | 22 | 41 | 36 | 64 | 0.9 | 22 | 41 | 37 | 64 | 1.76 | 1–2 |
| | | | | | 76% Cold Reduction | | | | | | |
| 0.4 | 22 | 41 | 36 | 65 | 0.5 | 22 | 41 | 36 | 66 | 1.96 | 2 |
| | | | | | 85% Cold Reduction | | | | | | |
| 0.3 | 22 | 41 | 34 | — | 0.4 | 22 | 41 | 37 | — | 1.92 | 2–3 |

containing less than 0.01% total aluminum is much smaller and considerably more uniform after recrystallization annealing than a ferritic stainless steel of the prior art containing 0.022% total aluminum.

EXAMPLE 4

Figure 7:
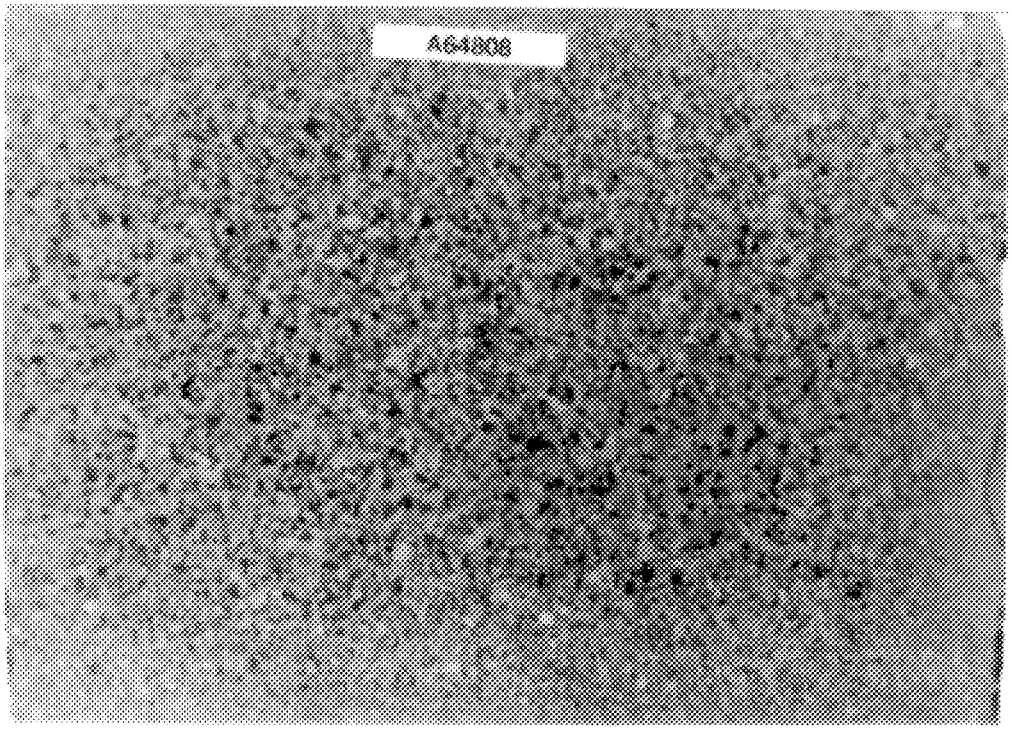
FIG. 7 is a photograph of the as-cast grain microstructure of another ferritic chromium alloyed steel of this invention containing low aluminum.

Another chromium alloyed ferrous melt of this invention was produced similar to that of Example 3. After final trim alloying elements were added to the vessel, the low aluminum melt was deoxidized with titanium. The composition of the melt was 0.19% Ti, 0.006% Al, 0.007% C, 0.13% Mn, 0.31% Si, 11.0% Cr, 0.16% Ni, 0.008% N, 0.001% S, 0.10% Cu, 0.03% Mo, 0.026% V and 0.0012% Ca. The steel melt was continuously cast into thin slabs having a thickness of 130 mm. An as-cast microstructure of a cross-section piece cut from these thin slabs is shown in FIG. 7. FIG. 7 illustrates that a ferritic stainless steel of this invention having 0.006% Al had a microstructure of nearly 100% equiaxed grains having a size of about 1 mm.

The slab was reheated to 1250° C., hot processed to a thickness of 3.0 mm with a finishing temperature of 800° C. and coiled at a temperature of 700° C. The hot processed sheet was descaled and pickled in nitric and hydrofluoric acid. The hot processed sheet was cold reduced 53% to a thickness of 1.4 mm. This hot processed sheet was not annealed prior to cold reduction. The cold reduced sheet was annealed at peak metal temperature of 940° C. for 10 seconds. After stretching, the ridging characteristic on the annealed sheet was 1–2 and had an $r_m$ value of 1.39–1.48. A ridging characteristic of 2 means good ridging characteristics. Mechanical properties of the sheets of the invention are summarized in Table 3.

EXAMPLE 5

Another 130 mm thickness thin slab of the composition described in Example 4 was reheated to 1250° C., hot processed into sheets having a thickness of 4.1 mm with a finishing temperature of 830° C. and coiled at a temperature of 720° C. The hot processed sheets were descaled, pickled in nitric and hydrofluoric acid and then cold reduced 66%, 76% and 85% corresponding to thicknesses of 1.4, 1.0 and 0.6 mm respectively. These hot processed sheets of the invention were not annealed prior to cold reduction. The cold reduced sheets were annealed at peak metal temperature of 940° C. for 10 seconds. After stretching, the ridging characteristic on the annealed sheets generally was 2 or better and had an $r_m$ value of 1.76–1.96. An $r_m$ value of ≧1.7 is considered outstanding for ferritic stainless steel and previously was not believed to be possible. Mechanical properties of the sheets of the invention are summarized in Table 4.

Figure 8:
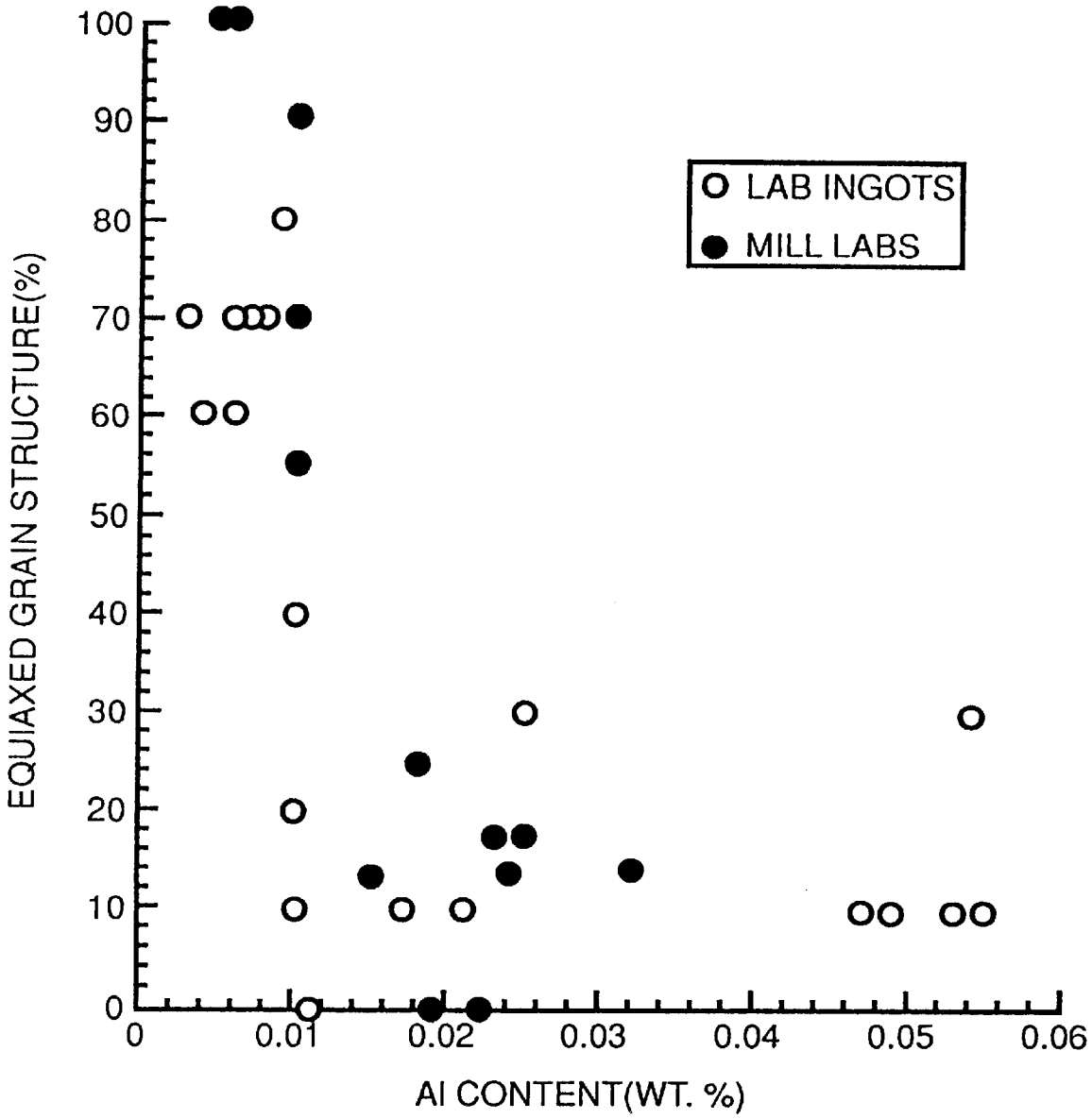
FIG. 8 is a graph illustrating the percentage of equiaxed grains in the as-cast microstructures for ferritic chromium alloyed steels as a function of the aluminum content.

FIG. 8 illustrates the percentage of equiaxed grains in an as-cast microstructure as a function of the aluminum content for ferritic chromium alloyed steels deoxidized with titanium. The as-cast microstructures for ferritic chromium alloyed steels for this invention are those that contain ≦0.010% Al. For steels containing less than 0.01% Al, the microstructures all contain at least 60% fine equiaxed grains and up to as much as 80% or more fine equiaxed grains. For steels containing about 0.02% or more Al, the as-cast microstructure generally contains no more than about 20% equiaxed grains, i.e., essentially columnar.

It will be understood various modifications may be made to this invention without departing from the spirit and scope of it. Therefore, the limits of this invention should be determined from the appended claims.

What is claimed is:

1. A chromium alloyed ferritic steel comprising:

the steel having an as-cast microstructure >50% equiaxed grains, the as-cast steel containing ≦0.010% Al, up to 0.08% C, up to 1.50% Mn, ≦0.05% N, ≦1.5% Si, 8–25% Cr, <2.0% Ni and means for deoxidizing the steel, all percentages by weight, the balance Fe and residual elements, the deoxidizing means consisting of titanium.

2. A chromium alloyed ferritic steel sheet comprising:

the sheet formed from a steel having an as-cast microstructure >50% equiaxed grains, the as-cast steel containing ≦0.010% Al, up to 0.08% C, up to 1.50% Mn, ≦0.03% N, ≦1.5% Si, 8–25% Cr, <2.0% Ni and means for deoxidizing the steel, all percentages by weight, the balance Fe and residual elements, the deoxidizing means consisting of titanium wherein Ti and N are present in sub-equilibrium amounts.

3. A chromium alloyed ferritic steel sheet comprising:

the sheet being recrystallization annealed and essentially free of ridging, the annealed sheet cold reduced from a hot processed sheet, the hot processed sheet formed from a steel having an as-cast microstructure >50% equiaxed grains containing ≦0.010% Al, up to 0.08% C, up to 1.50% Mn, ≦0.05% N, ≦1.5% Si, 8–25% Cr, <2.0% Ni and means for deoxidizing the steel, all percentages by weight, the balance Fe and residual elements, the deoxidizing means consisting of titanium.

4. The steel of claim 3 wherein the Ti and N are present in sub-equilibrium amounts.

5. The steel of claim 4 wherein the sub-equilibrium amount of Ti is ≧0.01% and satisfies the relationship (Ti/48)/[(C/12)+(N/14)]>1.5.

6. The steel of claim 3 wherein Ti is 0.050–1.0%.

7. The steel of claim 4 wherein N≦0.012% and Ti≦0.25%.

8. The steel of claim 3 wherein the equiaxed grains have a size less than 3 mm.

9. The steel of claim 3 wherein the Al is <0.010%.

10. The steel of claim 7 wherein the Al is ≦0.007%.

11. The steel of claim 9 wherein the microstructure is at least 60% equiaxed grains.

12. The steel of claim 10 wherein the microstructure is at least 80% equiaxed grains.

13. The steel of claim 10 wherein the microstructure is substantially free of columnar grains.

14. The steel of claim 3 wherein Ca is ≦0.0020%.

15. The steel of claim 3 wherein the annealed sheet has an $r_m$ value of ≧1.4.

16. The steel of claim 10 wherein the annealed sheet has an $r_m$ value of ≧1.7.

17. A chromium alloyed ferritic steel sheet comprising:

the sheet being recrystallization annealed and essentially free of ridging, the annealed sheet cold reduced from a hot processed sheet not previously annealed prior to the cold reduction, the hot processed sheet formed from a steel having an as-cast microstructure ≧80% equiaxed grains containing ≦0.007% Al, up to 0.02% C, up to 1.50 Mn, ≦0.012% N, ≦1.5% Si, 8–25% Cr, <2.0% Ni and means for deoxidizing the steel, all percentages by weight, the balance Fe and residual elements, the deoxidizing means consisting of 0.050–0.25% Ti wherein Ti and N are present in sub-equilibrium amounts.

18. A process for making chromium alloyed steel, comprising the steps of:

refining a chromium alloyed ferrous melt, adding means to the melt to deoxidize the melt, the deoxidizing means consisting of titanium, casting the melt into a steel having an as-cast microstructure >50% equiaxed grains, the steel containing ≦0.010% Al, up to 0.08% C, up to 1.50% Mn, ≦0.05% N, ≦1.5% Si, 8–25% Cr, ≦2.0% Ni, all percentages by weight, the balance Fe and residual elements, and hot processing the steel into a continuous sheet.

19. A process for making chromium alloyed steel, comprising the steps of:

refining a chromium alloyed ferrous melt, adding a means to the melt to deoxidize the melt, the deoxidizing means consisting of titanium, casting the melt into a steel having an as-cast microstructure ≧60% equiaxed grains, the steel containing <0.010% Al, up to 0.08% C, up to 1.50% Mn, ≦0.03% N, ≦1.5% Si, 8–25% Cr, <2.0% Ni, Ti and N being present in sub-equilibrium amounts, all percentages by weight, the balance Fe and residual elements, hot processing the steel into a continuous sheet, descaling the sheet, cold reducing the sheet to a final thickness, and recrystallization annealing the cold reduced sheet wherein the annealed sheet is essentially free of ridging.

20. The process of claim 19 wherein the sub-equilibrium amount of Ti is ≧0.01% and satisfies the relationship (Ti/48)/[(C/12)+(N/14)]>1.5.

21. The process of claim 19 wherein the deoxidizing means is commercially pure titanium.

22. The process of claim 19 wherein the deoxidizing means forms titanium oxide particles for forming nucleation sites for the equiaxed grains, the particles having a size less than 10 $\mu$m.

23. The process of claim 19 wherein the melt is continuously cast into a thin slab having a thickness ≦140 mm, the additional step of reheating the slab to a temperature of 1050°–1300° C. prior to hot rolling the slab into the continuous sheet.

24. The process of claim 19 wherein the cold reduced sheet is annealed at a temperature of 800°–1000° C. for at least 1 second.

25. A process for making chromium alloyed steel, comprising the steps of:

refining a chromium alloyed ferrous melt, adding means to deoxidize the melt, the deoxidizing means consisting of 0.050–0.25% of Ti, casting the melt into a chromium alloyed steel having an as-cast microstructure having ≧80% equiaxed grains, the steel containing ≦0.007% Al, up to 0.02% C, 1.50% Mn, ≦0.012% N, ≦1.5% Si, 8–25% Cr, <2.0% Ni, all percentages by weight, the balance Fe and residual elements, wherein (Ti/48)/[(C/12)+(N/14)]>1.5 and Ti and N are present in sub-equilibrium amounts, hot processing the steel into a continuous sheet, descaling the sheet, cold reducing the sheet to a final thickness, and recrystallization annealing the cold reduced sheet wherein the sheet is essentially free of ridging.

* * * * *

UNITED STATES PATENT AND TRADEMARK OFFICE

CERTIFICATE OF CORRECTION

PATENT NO. : 5,868,875
DATED : February 9, 1999
INVENTOR(S) : Eizo Yoshitake, et al.

It is certified that error appears in the above-identified patent and that said Letters Patent is hereby corrected as shown below:

On the title page, insert item [73] Assignee:
-- Armco Inc. Middletown, Ohio --.

In the figure on the title page,
"MILL LABS" should read --MILL SLABS--.

IN FIG. 8:

"MILL LABS" should read --MILL SLABS--.

IN THE CLAIMS:

In claim 17, line 9, please insert --%-- after "up to 1.50" and before "Mn".

In claim 25, line 8, please insert --up to-- after "0.02% C," and before "1.50% Mn".

Signed and Sealed this

Twenty-seventh Day of July, 1999

*Attest:*

Q. TODD DICKINSON

*Attesting Officer*

*Acting Commissioner of Patents and Trademarks*